United States Patent [19]

Hartman et al.

[11] Patent Number: 4,837,756

[45] Date of Patent: Jun. 6, 1989

[54] PERIMETRICAL WATCH PROTECTOR

[76] Inventors: James Hartman, 904 Elmwood Trail; Blake Schwartzman, 913 Elmwood Trail, both of Cedar Park, Tex. 78613

[21] Appl. No.: 176,239

[22] Filed: Mar. 31, 1988

Related U.S. Application Data

[63] Continuation-in-part of Ser. No. 19,752, Feb. 27, 1987, abandoned.

[51] Int. Cl.[4] ..... G04B 37/00

[52] U.S. Cl. ..... 368/286

[58] Field of Search ..... 368/280–282, 368/286; 224/169, 170, 173, 178

[56] References Cited

U.S. PATENT DOCUMENTS

| | | | |
|---|---|---|---|
| 1,101,500 | 6/1914 | Murphey | 224/170 |
| 1,199,256 | 9/1916 | Farr | 368/286 |
| 1,249,906 | 12/1917 | Daw | 368/286 |
| 2,511,105 | 6/1950 | Fenyvessy | 224/4 |
| 2,565,822 | 8/1951 | McClelland | 368/286 |
| 2,582,473 | 1/1952 | Belfert | 224/4 |
| 3,712,049 | 1/1973 | Luxembourg | 224/4 D |
| 4,277,842 | 7/1981 | Richards | 368/282 |
| 4,511,261 | 4/1985 | Mishima | 368/286 |
| 4,592,660 | 6/1986 | Hartman et al. | 368/206 |
| 4,635,416 | 4/1953 | Mietchen | 368/282 |

FOREIGN PATENT DOCUMENTS

| | | | |
|---|---|---|---|
| 1772 | of 1914 | United Kingdom | 224/170 |
| 102641 | 12/1916 | United Kingdom | 368/286 |
| 1056694 | 4/1917 | United Kingdom | 368/286 |
| 106357 | 5/1917 | United Kingdom | 368/286 |
| 103815 | 6/1917 | United Kingdom | 368/286 |
| 110048 | 10/1917 | United Kingdom | 368/286 |

*Primary Examiner*—Vit W. Miska

*Attorney, Agent, or Firm*—Thomas P. Mahoney

[57] ABSTRACT

A perimetrical watch protector has a protector or guard portion located perimetrically of the face of the watch and has resilient retainer lugs formed integrally with said protector or guard portion. The retainer lugs include downwardly extending resilient lugs which overlie the adjacent portions of the edge of the watch, and retainer bands are formed integrally therewith which engage the back of the watch.

5 Claims, 1 Drawing Sheet

PERIMETRICAL WATCH PROTECTOR

This application is a continuation-in-part of U.S. Ser. No. 07/019,752, filed Feb. 27, 1987 for PERIMETRICAL WATCH PROTECTOR, now abandoned.

BACKGROUND OF THE INVENTION

This invention relates to a perimetrical watch protector which incorporates a perimetrical protector or guard portion located adjacent the perimeter of the crystal of the watch, and being so formed as to isolate said crystal from abrasive contact.

There are numerous prior art devices intended to accomplish the desirable end of crystal protection, among them being applicants' U.S. Pat. No. 4,592,660 and the various patents included in the list of prior art references supplied with this application.

Although our '660 patent discloses a watch protector which is a major advance over the prior art in that it is, among other advantages, centrally located over the crystal to isolate the crystal from abrasive contact, it is possible that the crystal may be abrasively engaged at the edges of the crystal.

Moreover, our prior art device discloses a centrally-located guard member which prevents the reading of the watch hands when they are located in the central position on the watch. This is not a major disadvantage in that the owner of the watch can determine from other conditions what the location of the hands should be. However, if the watch has stopped in this critical position, it will be some time before perception of such stoppage occurs.

Other prior art devices include metal shells which cover the face of the watch making the reading of the time, as indicated by hands of the watch, extremely difficult.

These metal shells are intended to convert a pocket watch into a wrist watch, but do not afford any protection to the crystal of the watch since they are disposed outwardly of the crystal and are located, generally, in the plane of the crystal.

The protection of the crystal of the watch becomes extremely important when, as in many high-fashion or mass-produced watches, the crystal is fabricated from synthetic plastics and, thus, is more prone to be readily abraded or scratched, thus obscuring portions of the watch face and, in addition, detracting from the decorative effect of the watch.

OBJECTS AND ADVANTAGES OF THE INVENTION

It is a principal object of the invention to provide a perimetrical watch protector which incorporates a perimetrical protector or guard portion located adjacent the perimeter of the watch crystal and which does not, in any way, obscure the reading of the hands of the watch.

Another object of the invention is the provision of a protector of the aforementioned character which eliminates the need for utilization of the strap as a means of affixing the protector in overlying relationship with the watch by providing resilient mounting lug members engageable with the edges and back of the watch.

Another object of our invention is the provision of a watch protector of the aforementioned character wherein the perimetrical protector or guard portion is of sufficient height to isolate the face of the watch and the overlying crystal from abrasive contact. Since the guard is perimetrically located, the possibility of edgewise intrusion of an abrasive article is eliminated.

Because of the provision of resilient lugs formed integrally with the protector or guard portion of the perimetrical watch protector, the watch protector can be readily mounted on and dismounted from operative relationship with the associated watch.

Another object of our invention is the provision of a watch protector wherein the perimetrical protector or guard portion located adjacent the perimeter of the watch crystal is spaced above the watch crystal to isolate it from deleterious contact with abrasive elements of the environment. Moreover, the perimetrical watch protector is fabricated from synthetic plastic which is resiliently deformable, thus permitting the deformation of the perimetrical protector or guard portion of the perimetrical watch protector and preventing both abrasive contact with the watch crystal and the shattering of the protector during such abrasive contact.

Another object of the invention is the provision of recesses in the retainer lugs of the watch protector which serve as receptacles for the adjacent portions of the watch case and which act to maintain the watch case in a position to space the face of the watch crystal from the protector or guard portion of the watch protector.

A correlative advantage of the invention is the fact that the resilient characteristics of the synthetic resin from which the watch protector is fabricated permit the lugs to be readily spread apart to release the watch case from operative engagement with the perimetrical watch protector, thus facilitating the replacement of one watch protector with another watch protector of a different design or color.

BRIEF DESCRIPTION OF THE DRAWINGS

Other objects and advantages of the invention will be apparent from the following specification and the accompanying drawings, which are for the purpose of illustration only, and in which.

DESCRIPTION OF THE PREFERRED EMBODIMENTS OF THE INVENTION

Figure 1:
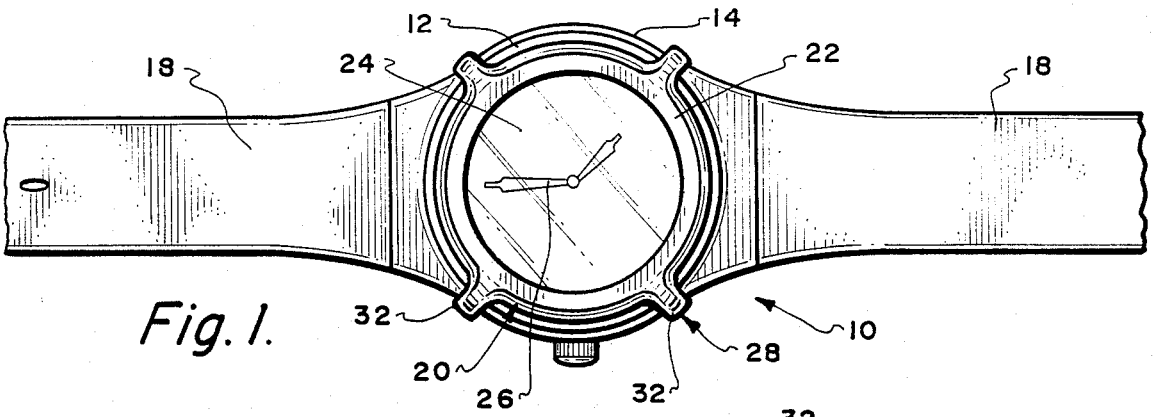
FIG. 1 is a top plan view of the watch protector of the invention mounted in overlying relationship with an associated wristwatch.
Figure 2:
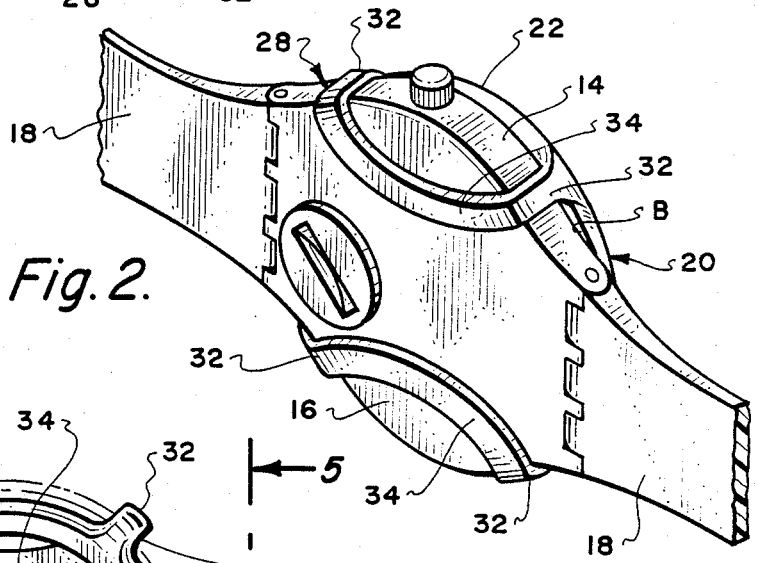
FIG. 2 is an isometric view illustrating the manner in which the resilient lugs of the watch protector engage the edges and back of the watch.
Figure 3:
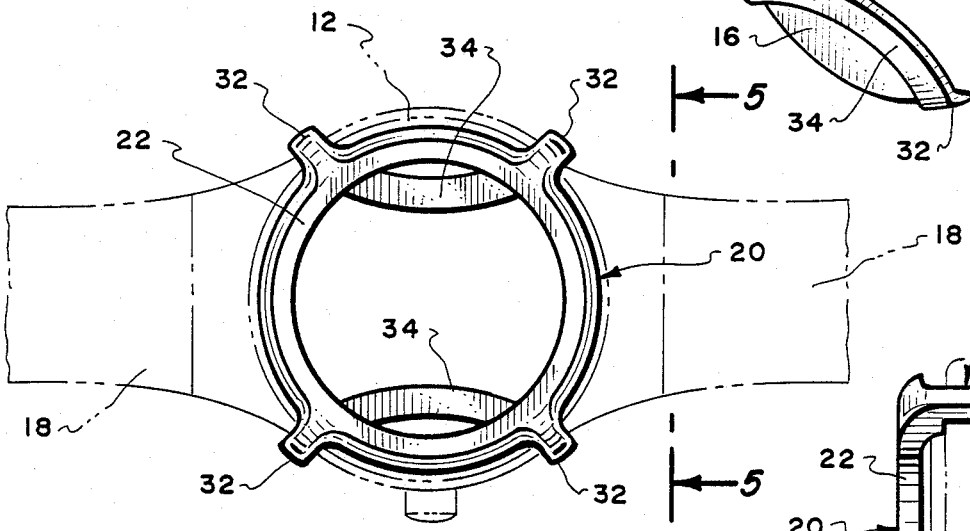
FIG. 3 is a top plan view of the watch protector.

Referring to the drawings, and particularly to FIGS. 1–2 thereof, we show a wristwatch 10 incorporated in a case 12 having a generally circular configuration and including an edge 14 of correspondingly circular configuration with a back 16. Straps 18 facilitate the securement of the watch 10 to the wrist of the wearer of the watch.

Mounted upon the watch case 12 is a perimetrical watch protector 20, said perimetrical watch protector having a perimetrical watch or guard portion 22 which is disposed adjacent the perimetrical edge of the watch crystal 24 through which the hands 26 of the watch can be observed.

Because the watch case 12 and crystal 24 of the watch 10 are of circular configuration, the perimetrical guard or protector portion 22 is correspondingly circular in configuration, but it is not intended that all embodiments of the watch guard or watch protector of the invention be limited to that configuration since it can be fabricated to conform to other watch case shapes, such as rectangular, square or the like.

Figure 4:
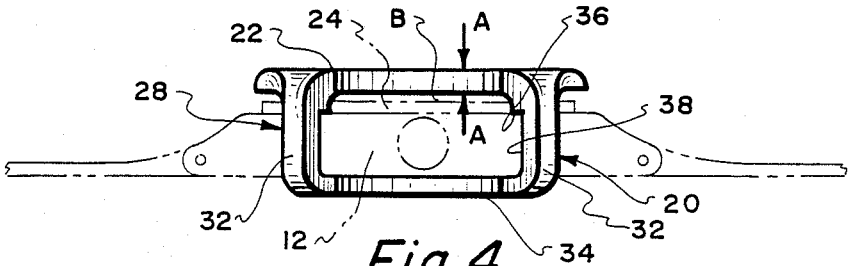
FIG. 4 is a side elevational view of the watch protector taken from the broken line 4—4 of FIG. 3.

Moreover, the protector or guard portion 22 can be fabricated in any desired cross-sectional configuration, although it is imperative that the vertical thickness A—A, FIG. 4, of the perimetrical protector or guard portion be sufficient to satisfactorily isolate the watch crystal 24 from abrasive contact. However, unlike prior watch guards or protectors, no obscurement of the face or hands 26 of the watch 10 occurs.

Although it is preferred that the perimetrical watch protector 20 be fabricated from synthetic plastic material such as polyethylene, polypropylene or other plastic materials having resilient characteristics, it will be obvious to those skilled in the art that a wide variety of different materials can be utilized in substitution therefor. It is also intended that the protector 20 be provided in a wide variety of colors and surface textures. In addition, the area of the protector or guard portion 22 may be extended outwardly to provide various artistic configurations such as flower petals or the like.

Formed integrally with the protector or guard portion 22 is a pair of retainer lugs 28 which include legs 32 extending rearwardly across the relevant portions of the edge 14 of the watch case 12. Formed integrally with the legs are retainer bands 34 which underlie the back 16 of the watch 10.

It will be noted that the retainer lugs 28 as constituted by the legs 32 and retainer bands 34 define elongated apertures 35 which permit the protrusion of the relevant portions of the watch case through the lugs 28 and which permit the secure engagement of said watch case.

Figure 5:
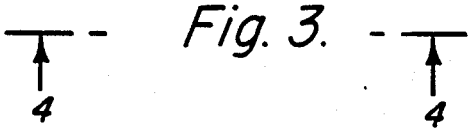
FIG. 5 is a view taken from the broken line 5—5 of FIG. 3.
Figure 5:
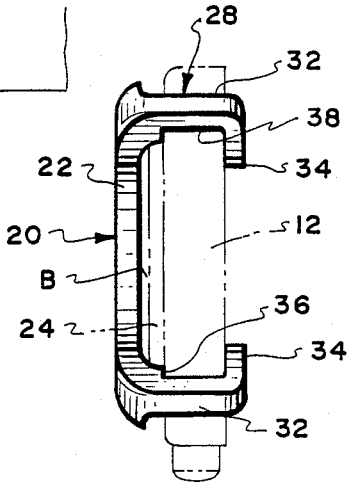

Each of the legs 32 is provided with a watch case engaging land 36, as best shown in FIGS. 4–6 of the drawings. The lands 36 engage the upper surface of the watch case, as best shown in FIG. 5, and securely locate the case in recesses or receptacles 38 defined between the retainer bands 34 and the lands 36.

Consequently, a space B is created between the top of the watch case 12 and the underside of the perimetrical guard or protector portion 22. Therefore, the case 12 is normally isolated from abrasive or other deleterious contacts. The space B, as best shown in FIG. 5, permits the underside of the perimetrical guard or protector portion 22 to totally isolate the crystal 24 in the same manner as the watch case 12 is isolated and breakage and abrasion of the crystal 24 are substantially eliminated.

As will be readily apparent to those skilled in the art, the perimetrical watch protector 20 can be formed in a wide variety of alternative configurations and designs, and it is not intended that the circular configuration of the guard or protector be considered as limiting.

The installation of the perimetrical watch protector 20 upon the watch 10 is accomplished with ease previously unknown in watch protectors since the highly resilient retaining lugs 28 may be spread to permit them to be snapped over the relevant edge portions 12 and back 16 of the associated watch. As a matter of fact, one of the most desirable ways of installing the watch protector 20 is to engage one of the retaining lugs 28 with one area of the edge 12 of the watch 10 and then engage the opposite retaining lug 28 over the opposed portion of the edge 14 of the watch case 12.

Therefore, it is not necessary, as in many prior art devices, to mount the watch guard in operative relationship with the watch face by engagement of portions of the guard with the straps of the watch.

We claim:

1. A perimetrical watch protector for a watch; said watch having a watch case, a face and a crystal overlying said face, said case having an edge and a back; comprising a perimetrical guard for encompassing said crystal, the surface of said perimetrical guard, arranged to confront said crystal when said guard is in place on said watch, lying in a predetermined plane; a plurality of retainer lugs integral with said perimetrical guard, said lugs projecting transversely to said plane of said surface of said perimetrical guard and being resilient to snap over said edge of said watch; and a plurality of retainer bands, each joining the ends of at least two of said lugs opposite said perimetrical guard, for engaging the back of said watch, said lugs each having a land, facing away from said perimetrical guard and spaced from said predetermined plane of said surface of said perimetrical guard, for engaging said watch case to maintain said surface of said perimetrical guard confronting said crystal in spaced relationship with said crystal and watch case to isolate said watch case and crystal from deleterious abrasion and impact.

2. The watch protector of claim 1 in which said perimetrical guard is circular and is spaced from said crystal and said case and is resilient to permit the deflection thereof to absorb inadvertent blows to which said crystal and case might be subjected.

3. The watch protector of claim 2 in which said perimetrical guard has an upper surface and a lower surface, said lower surface being disposed in spaced relationship with said crystal and said case and being substantially parallel therewith.

4. The watch protector of claim 1 in which said perimetrical guard is a frame member surrounding an aperture for viewing said watch face and having a configuration substantially the same as the peripheral configuration of said crystal.

5. The watch protector of claim 1 in which said perimetrical guard has an annular configuration.

* * * * *